US012473677B2

(12) United States Patent
Brindzik

(10) Patent No.: US 12,473,677 B2
(45) Date of Patent: Nov. 18, 2025

(54) SYSTEMS, METHODS, AND APPARATUSES FOR GUIDING A SEWING OPERATION OF A SEWING MACHINE

(71) Applicant: Singer Sourcing Limited LLC, Nashville, TN (US)

(72) Inventor: Barbara Brindzik, Jönköping (SE)

(73) Assignee: Singer Sourcing Limited LLC, Nashville, TN (US)

( * ) Notice: Subject to any disclaimer, the term of this patent is extended or adjusted under 35 U.S.C. 154(b) by 0 days.

(21) Appl. No.: 18/235,962

(22) Filed: Aug. 21, 2023

(65) Prior Publication Data

US 2025/0066967 A1 Feb. 27, 2025

(51) Int. Cl.

| | |
|---|---|
| ***D05B 35/10*** | (2006.01) |
| ***D05B 19/08*** | (2006.01) |
| ***D05B 19/14*** | (2006.01) |

(52) U.S. Cl.

CPC ..... *D05B 35/102* (2013.01); *D05B 19/08* (2013.01); *D05B 19/14* (2013.01)

(58) Field of Classification Search

CPC ..... D05B 19/12; D05B 19/08; D05B 19/10; D05B 35/12; D05B 79/00; D05B 19/16; D05B 21/00; D05B 19/14; D05B 35/102

See application file for complete search history.

(56) References Cited

U.S. PATENT DOCUMENTS 5,042,410 A * 8/1991 Nakashima ..... D05B 19/02 112/306
5,072,680 A * 12/1991 Nakashima ..... D05B 79/00 353/28
5,195,451 A * 3/1993 Nakashima ..... D05B 79/00 112/102.5

(Continued)

FOREIGN PATENT DOCUMENTS

CN 201141080 Y * 10/2008
DE 4100057 A1 * 8/1991

(Continued)

OTHER PUBLICATIONS

International Searching Authority, International Search Report issued on PCT Application No. PCT/US24/41515 dated Nov. 14, 2024, 2 pages.

(Continued)

*Primary Examiner* — Danny Worrell

(74) *Attorney, Agent, or Firm* — Baker, Donelson, Bearman, Caldwell & Berkowitz, P.C.; Dominic A. Rota; Wesley M. Barbee

(57) ABSTRACT

A system and method, for guiding a sewing operation for a sewing machine, are provided herein. One of one or more stitch objects having stitch data associated therewith may be selected. Each of the one or more stitch objects are defined by a geometric pattern. The stitch data of the one of the one or more stitch objects is analyzed to identify one or more lines forming the geometric pattern. At least a portion of a (Continued)

sewing material is sewn, onto the workpiece with the needle, in a direction defined by a first of the one or more lines forming the geometric pattern. A primary light source projects a first of one or more guidelines onto the workpiece. The first of the one or more guidelines corresponds to a second of the one or more lines forming the geometric pattern.

20 Claims, 9 Drawing Sheets

(56) References Cited

U.S. PATENT DOCUMENTS

| | | | | |
|---|---|---|---|---|
| 6,934,599 | B2 | 8/2005 | Kaymer et al. | |
| 8,108,062 | B2 | 1/2012 | Kaymer et al. | |
| 8,606,390 | B2 | 12/2013 | Hjalmarsson et al. | |
| 8,683,932 | B2 | 4/2014 | Eklund et al. | |
| 9,650,734 | B2 * | 5/2017 | Elliott | D05B 19/08 |
| 10,392,736 | B2 | 8/2019 | Kongo | |
| 10,934,649 | B2 * | 3/2021 | Matsushima | D05B 19/16 |
| 11,060,221 | B2 * | 7/2021 | Minematsu | D05B 35/12 |
| 11,248,324 | B2 * | 2/2022 | Imaizumi | D05B 79/00 |
| 11,274,385 | B2 * | 3/2022 | Imaizumi | D05B 19/10 |
| 11,441,253 | B2 * | 9/2022 | Jaeger | D05B 19/16 |
| 11,634,846 | B2 * | 4/2023 | Minematsu | D05B 19/12 112/102.5 |
| 11,891,739 | B2 * | 2/2024 | Kamihira | D05B 19/12 |
| 12,215,449 | B2 * | 2/2025 | Kvarnstrand | D05B 19/02 |
| 2007/0206371 | A1 * | 9/2007 | Yamasaki | D05B 79/00 362/90 |
| 2008/0264319 | A1 * | 10/2008 | Hayakawa | D05B 19/04 112/470.04 |
| 2011/0146553 | A1 * | 6/2011 | Wilhelmsson | D05C 9/06 112/102.5 |
| 2012/0222602 | A1 * | 9/2012 | Hishida | D05B 23/00 112/470.05 |
| 2013/0014682 | A1 * | 1/2013 | Brindzik | D05B 19/10 112/154 |
| 2014/0216318 | A1 * | 8/2014 | Brindzik | D05B 19/12 112/470.04 |
| 2018/0010276 | A1 | 1/2018 | Kongo | |
| 2020/0291558 | A1 * | 9/2020 | Imaizumi | D05B 19/10 |
| 2021/0087729 | A1 * | 3/2021 | Oka | D05B 19/085 |
| 2022/0042226 | A1 | 2/2022 | Kvarnstrand et al. | |
| 2022/0335856 | A1 | 10/2022 | Kvarnstrand | |
| 2023/0099563 | A1 | 3/2023 | Imaizumi et al. | |
| 2024/0279859 | A1 * | 8/2024 | Matsushima | D05B 19/16 |

FOREIGN PATENT DOCUMENTS

| | | | | |
|---|---|---|---|---|
| DE | 4221747 | A1 * | 1/1993 | D05B 21/00 |
| WO | WO-2009085005 | A1 * | 7/2009 | D05B 19/10 |
| WO | WO-2019116821 | A1 * | 6/2019 | D05B 35/12 |

OTHER PUBLICATIONS

International Searching Authority, Written Opinion issued on PCT Application No. PCT/US24/41515 dated Nov. 14, 2024, 7 pages.

* cited by examiner

SYSTEMS, METHODS, AND APPARATUSES FOR GUIDING A SEWING OPERATION OF A SEWING MACHINE

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

FIELD OF THE DISCLOSURE

The present disclosure relates, in general, to apparatuses, systems, and methods for operating a sewing machine, and more particularly, to apparatuses, systems, and methods for guiding a sewing operation of a sewing machine.

BACKGROUND

Current models of sewing machines are used to form stitches in a variety of materials. A sewing machine may perform a variety of sewing operations, including (without limitation): forming stitches in a workpiece (e.g., fabric), attaching decorative features to a workpiece, cutting or hemming an edge of a workpiece, embellishing designs on a workpiece, and folding, rolling, or otherwise manipulating a workpiece. Each of these sewing operations are performed as the workpiece is moved and rotated underneath a needle housed within a sewing head, where the needle is configured to pass through the workpiece by cyclical movement. For each sewing operation, a user, or operator, of the sewing machine accounts for various parameters, including a size and shape of a stitch to be made on the workpiece, and by extension, a number of rotations or re-alignments to the workpiece that must be made to effectuate the stitch. Moreover, the user must consider other tools available with the sewing machine, whether such tools are removably engaged to the sewing machine or otherwise disposed or contained therein.

It is known that current models of sewing machines comprise complex mechanical structure (and movements) accompanied by computing elements related thereto. Sewing machines carry processors configured to execute instructions residing on a storage medium. Such storage medium may contain a variety of selectable designs for applicable stitchwork. A user may select a design, which enables the processor to execute a sewing operation to generate the selected design. Thereafter, the user may move a workpiece relative to the needle of the sewing machine, such movement being made in accordance with the data underlying the selectable design. In this way, a desired stitch is produced on the workpiece at least in part by computerized function.

In other current models of sewing machines, the sewing machines have a projector and/or camera housed within the sewing head, from which the needle extends downward therefrom. The camera may provide a user with a top-perspective view, or top plan view, of the workpiece, so as to visually convey, in enlarged or focused detail, a quality of the stitch. The projector, on the other hand, may project a design on the workpiece, serving as a blueprint of the sewing operation and stitchwork for the user of the sewing machine. Despite these capabilities, use of these sewing machines may be slow and cumbersome, and each of these capabilities cannot replicate a sewing operation performed by a human user of the sewing machine.

Given the number of drawbacks associated with current models of sewing machines, there is a need to provide a sewing machine that overcomes the foregoing limitations. Current sewing machines, and the computing elements and other tools contained therein (e.g., camera and/or projector), lead to inefficient and imprecise stitchwork in a sewing operation. While current sewing machines have moved away from innovations supporting free-motion stitching, what is needed is a system and method for guiding a sewing operation of the sewing machine by leveraging the computing elements and tools contained therein, so as to produce stitchwork efficiently and in a manner qualitatively similar to free-motion stitchwork.

BRIEF SUMMARY

The present disclosure addresses and/or provides advantages over the problems identified above, amongst others. Implementations consistent with the present disclosure provide systems, methods, and apparatuses for guiding a sewing operation of a sewing machine. Guiding the sewing operation of the sewing machine, as disclosed herein, may yield efficient stitchwork, and such stitchwork may have an aesthetic quality akin to stitchwork performed by free-motion (or free-hand) stitching.

The present disclosure provides a system and method for sewing thread onto a workpiece (or fabric) by using guidelines projected from a light source, which is housed within a sewing head of the sewing machine. To the extent a user desires to sew a particular shape or design onto the workpiece, a user may select, via a user interface of the sewing machine's onboard computing device, a stitch object. A storage medium (e.g., memory) of the onboarding computing device may have a number of stitch objects stored thereon, allowing for the user to select from a menu or list of stitch objects vis-à-vis the user interface. Each of these stitch objects may have geometries associated therewith, and each of these geometries may be comprised of one or more lines. The process may be in an exemplary embodiment conducted in a number of steps. The machine may, through a user interface, instruct the user to start sewing a first line. After, or upon, sewing an initial portion of the geometry that corresponds to a first line of the geometry, the light source may project a guideline to indicate a direction of subsequent sewing operation, thereby guiding the user to sew successive lines of the geometry. The guideline may be configured to guide the user to move the fabric, e.g., by rotation, into the new position, by aligning the previously sewn first line with the guideline. The machine may instruct the user, through the user interface, to conduct said alignment. After each line is sewn, a processor of the sewing machine's onboard computing device may terminate a sewing action, instructing or directing the user to align a needle of the sewing machine in accordance with a successive line of the geometry. This process is repeated, in sequence, until the thread is sewn onto the workpiece to generate the whole geometry of the stitch object.

The sewing machine may have a processor configured to execute instructions residing on a memory, the memory of which may have stitch data stored thereon. By retrieving the stitch data in response to a selection of one or more stitch objects, one or more lines forming a geometric pattern may be identified. Upon sewing a portion of sewing material onto a workpiece, a primary light source, such as a projector, may be projected onto the workpiece. The primary light source may project a guideline onto the workpiece, which indicates a successive (or subsequent) line of the geometric pattern.

For each line of the geometric pattern that is sewn, the primary light source may project further guidelines onto the workpiece for the successive line of the geometric pattern, which relates the successive line of the geometric pattern with the prior line. This sewing operation may be performed in sequence until all lines forming the geometric pattern are sewn onto workpiece.

In the context of guiding a sewing operation of a sewing machine, a method is provided herein. The sewing machine may have a needle configured to pass through a workpiece by reciprocal movement. The method may commence with selecting one of one or more stitch objects having stitch data associated therewith. Each of the one or more stitch objects may be defined by a geometric pattern. The method may continue by analyzing the stitch data of the one of the one or more stitch objects to identify one or more lines forming the geometric pattern. The method may continue by sewing, onto the workpiece with the needle, at least a portion of a sewing material in a direction defined by a first of the one or more lines forming the geometric pattern. The method may further continue with activating a primary light source to project a first of one or more guidelines onto the workpiece. The first of the one or more guidelines may be aligned with the first of the one or more lines to provide a direction of a second of the one or more lines forming the geometric pattern.

In the context of operating a sewing machine, a method is provided herein. The sewing machine may have a processor configured to execute instructions residing on a memory, wherein the memory may have stitch data stored thereon. The sewing machine may have a needle configured to periodically pass through a workpiece by reciprocal movement. The method may commence by selectively retrieving the stitch data in response to a selection of one of one or more stitch objects. Each of the one or more stitch objects may be defined by a geometric pattern. The method may continue with identifying one or more lines forming the geometric pattern of the one of the one or more stitch objects. Upon sewing, onto the workpiece with the needle, at least a portion of a sewing material in accordance with a direction defined by one of the one or more lines forming the geometric pattern, the method may further continue with projecting, from a primary light source, a guideline onto the workpiece. The guideline may indicate a direction of a successive second or more of the one or more lines forming the geometric pattern, and the second or more of the one or more lines may be connected to the one of the one or more lines on which the at least a portion of the sewing material was sewn.

In the context of guiding a sewing operation of a sewing machine, a system is provided herein. The system may include a sewing head, a primary light source, a processor, and a memory. The sewing head may be arranged above a workpiece. The sewing head may include a needle configured to periodically pass through a workpiece by reciprocal movement. The primary light source may be configured to project one or more guidelines onto the workpiece. The processor may be configured to execute instructions residing on a memory, wherein the memory may have stitch data stored thereon. The processor may be configured to receive a selection of one of one or more stitch objects. Each of the one or more stitch objects may be defined by a geometric pattern. The processor may be further configured to analyze the stitch data of the one of the one or more stitch objects to identify one or more lines associated with the geometric pattern. The processor may yet be further configured to direct the primary light source to project a guideline onto the workpiece. The guideline may be generated relative to a direction defined by sewing material sewn onto the workpiece in accordance with one of the one or more lines associated with the geometric pattern. The guideline may be aligned with the one of the one or more lines to provide a direction of a successive, connecting one of the one or more lines associated with the geometric pattern.

In a particular embodiment, a method for guiding a sewing operation for a sewing machine is disclosed. The sewing machine has a needle configured to periodically pas through a workpiece by reciprocal movement. The method commences with an operation of selecting one of one or more stitch objects having stitch data associated therewith. Each of the one or more stitch objects are defined by a geometric pattern. The method continues with an operation of analyzing the stitch data of the one of the one or more stitch objects to identify one or more lines forming the geometric pattern. The method continues with an operation of sewing, onto the workpiece with the needle, at least a portion of a sewing material in a direction defined by a first of the one or more lines forming the geometric pattern. The method continues with an operation of activating a primary light source to project a first of one or more guidelines onto the workpiece. The first of the one or more guidelines are aligned with the first of the one or more lines to provide a direction of a second of the one or more lines forming the geometric pattern.

In one aspect according to the above-referenced embodiment, the operation of activating the primary light source may further comprise an operation of activating a secondary light source to project a reference line onto the workpiece. The reference line may indicate a direction in which the at least a portion of the sewing material is configured to be sewn on the workpiece.

In another aspect according to the above-referenced embodiment, after the operation of activating the primary light source, the at least a portion of the sewing material may be sewn, onto the workpiece with the needle, in accordance with the second of the one or more lines forming the geometric pattern.

As an exemplary aspect according to the above-referenced embodiment, the method may further comprise an operation of projecting, via the primary light source, a second of one or more guidelines onto the workpiece. The second of the one or more guidelines may be aligned with the second of the one or more lines to provide a direction of a third of the one or more lines forming the geometric pattern.

In another aspect according to the above-referenced embodiment, the method may further comprise an operation of rotating the workpiece to sew, onto the workpiece with the needle, the at least a portion of the sewing material in a direction aligned with the second of the one or more lines forming the geometric pattern.

In another aspect according to the above-referenced embodiment, the one or more lines forming the geometric pattern may be defined as two-dimensional vectors in an x-y coordinate space.

In another aspect according to the above-referenced embodiment, the operation of analyzing the stitch data of the one of the one or more stitch objects may further include to identify an angle of a connecting pair of the one or more lines forming the geometric pattern. A direction of the first of one or more guidelines may be determined by the angle connecting the first of the one or more guidelines with the at least a portion of the sewing material sewn on the workpiece in a direction defined by the first of the one or more lines forming the geometric pattern.

In another aspect according to the above-referenced embodiment, the operation of analyzing the stitch data of the one of the one or more stitch objects may further include to identify a length of each of the one or more lines forming the geometric pattern. A direction of the first of one or more guidelines may be determined by the length of the at least portion of the sewing material sewn onto the workpiece in a direction defined by the first of the one or more lines forming the geometric pattern.

In another particular embodiment, a method of operating a sewing machine is disclosed. The sewing machine has a processor configured to execute instructions residing on a memory, the memory of which has stitch data stored thereon. The sewing machine has a needle configured to periodically pass through a workpiece by reciprocal movement. The method commences with an operation of selectively retrieving the stitch data in response to a selection of one of one or more stitch objects. Each of the one or more stitch objects are defined by a geometric pattern. The method continues with an operation of identifying one or more lines forming the geometric pattern of the one of the one or more stitch objects. Upon sewing, onto the workpiece with the needle, at least a portion of a sewing material in accordance with a direction defined by one of the one or more lines forming the geometric pattern, the method continues with an operation of projecting, from a primary light source, a guideline onto the workpiece. The guideline indicates a direction of a successive second or more of the one or more lines forming the geometric pattern. The second or more of the one or more lines is connected to the one of the one or more lines on which the at least a portion of the sewing material was sewn.

In one aspect according to the above-referenced embodiment, the method may further comprise an operation of activating a secondary light source to project a reference line onto the workpiece. The reference line may indicate a direction in which the at least a portion of the sewing material is configured to be sewn on the workpiece.

In another aspect according to the above-referenced embodiment, the method may further comprise an operation of rotating the workpiece to sew, onto the workpiece with the needle, the at least a portion of the sewing material in a direction aligned with the successive second or more of the one or more lines forming the geometric pattern.

In another aspect according to the above-referenced embodiment, the one or more lines forming the geometric pattern may be defined as two-dimensional vectors in an x-y coordinate space.

As an exemplary aspect according to the above-referenced embodiment, two-dimensional vectors in the x-y coordinate space may be correlated with a two-dimensional plane defined by a surface of the workpiece.

In another aspect according to the above-referenced embodiment, the operation of identifying the one or more lines may further include analyzing the stitch data to determine an angle of a connecting pair of the one or more lines forming the geometric pattern of the one of the one or more stitch objects. A direction of the guideline may be determined by the angle connecting the guideline with the at least a portion of the sewing material sewn on the workpiece in a direction defined by the one of the one or more lines forming the geometric pattern.

In another aspect according to the above-referenced embodiment, the operation of identifying the one or more lines may further include analyzing the stitch data to determine a length of each of the one or more lines forming the geometric pattern of the one of the one or more stitch objects. A direction of the guideline may be determined by the length of the at least portion of the sewing material sewn onto the workpiece in a direction defined by the one of the one or more lines forming the geometric pattern.

In yet another particular embodiment, a system for guiding a sewing operation a sewing machine is disclosed. The system includes a sewing head, a needle, a primary light source, a processor, and a memory. The sewing head is arranged above a workpiece, and the sewing head comprises the needle configured to periodically pass through a workpiece by reciprocal movement. The primary light source is configured to project one or more guidelines onto the workpiece. The processor is configured to execute instructions residing on a memory. The memory has stitch data stored thereon. The processor is configured to receive a selection of one of one or more stitch objects. Each of the one or more stitch objects is defined by a geometric pattern. The processor is further configured to analyze the stitch data of the one of the one or more stitch objects to identify one or more lines associated with the geometric pattern. The processor is yet further configured to direct the primary light source to project a guideline onto the workpiece. The guideline is generated relative to a direction defined by sewing material sewn onto the workpiece in accordance with one of the one or more lines associated with the geometric pattern. The guideline is aligned with the one of the one or more lines to provide a direction of a successive, connecting one of the one or more lines associated with the geometric pattern.

In one aspect according to the above-referenced embodiment, the system may further comprise a secondary light source configured to project a reference line onto the workpiece. The reference line indicates a direction in which the sewing material is configured to be sewn onto the workpiece.

In another aspect according to the above-referenced embodiment, the one or more lines associated with the geometric pattern may be defined as two-dimensional vectors in an x-y coordinate space.

In another aspect according to the above-referenced embodiment, the processor may further be configured to analyze the stitch data to identify an angle of a connecting pair of the one or more lines associated with the geometric pattern of the one of the one or more stitch objects.

In another aspect according to the above-referenced embodiment, the processor may further be configured to analyze the stitch data to determine a length of each of the one or more lines associated with the geometric pattern of the one of the one or more stitch objects.

Unless otherwise defined, all technical and scientific terms used herein have the same meaning as commonly understood by one of ordinary skill in the art to which this disclosure belongs. The present disclosure may be embodied in other specific forms without departing from the spirit or essential attributes thereof, and it is therefore desired that the embodiments of the disclosure be considered in all aspects as illustrative and not restrictive. Any headings utilized in the description are for convenience only and no legal or limiting effect. Numerous objects, features, and advantages of the embodiments set forth herein will be readily apparent to those skilled in the art upon reading of the following disclosure when taken in conjunction with the accompanying drawings.

BRIEF DESCRIPTION OF THE DRAWINGS

Hereinafter, various exemplary embodiments of the disclosure are illustrated in more detail with reference to the drawings.

DETAILED DESCRIPTION

Figure 1:
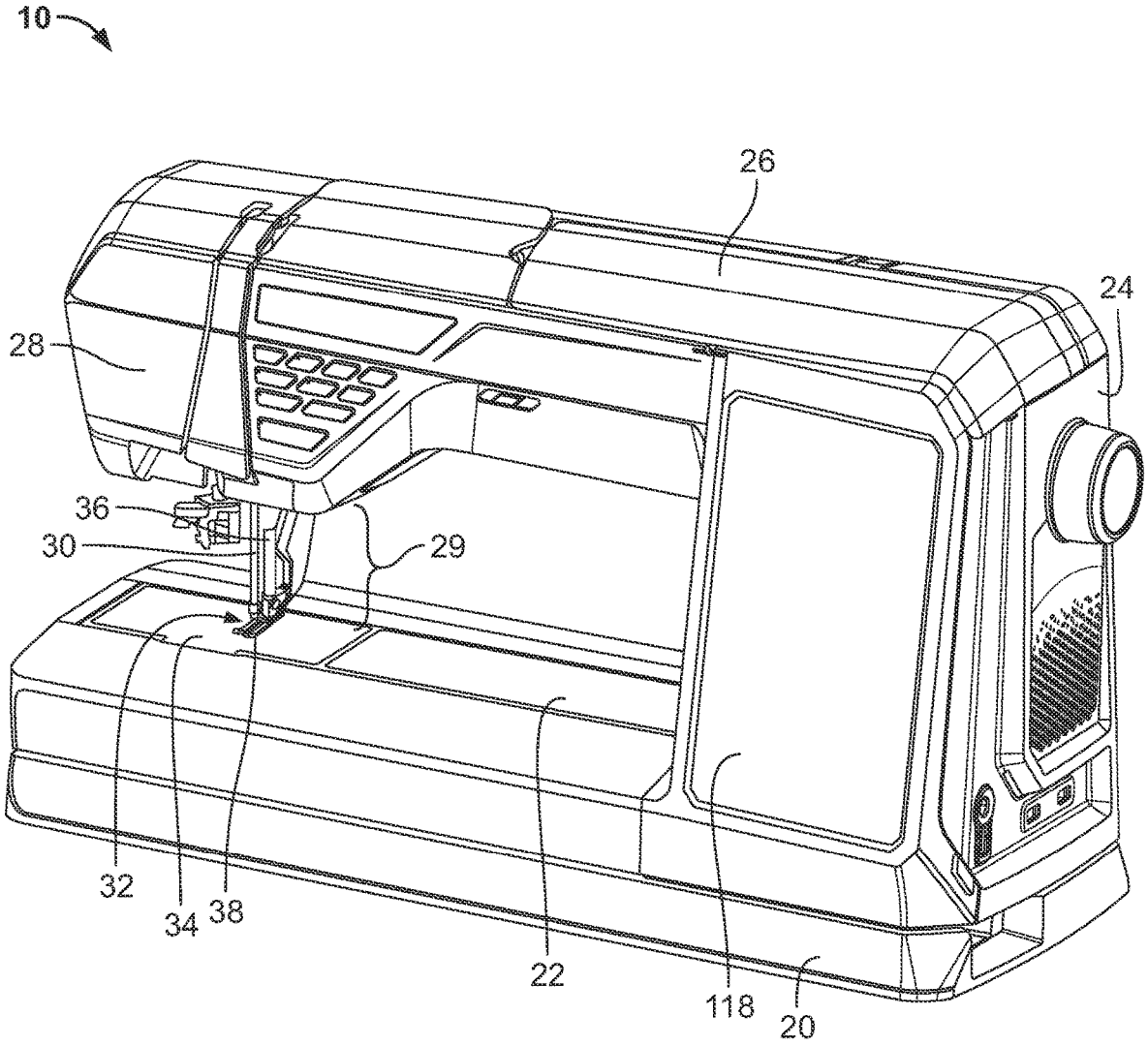
FIG. 1 is a perspective view of an exemplary embodiment of a sewing machine, in accordance with the present disclosure.

Reference will now be made in detail to embodiments of the present disclosure, one or more drawings of which are set forth herein. Each drawing is provided by way of explanation of the present disclosure and is not a limitation. In fact, it will be apparent to those skilled in the art that various modifications and variations can be made to the teachings of the present disclosure without departing from the scope of the disclosure. For instance, features illustrated or described as part of one embodiment can be used with another embodiment to yield a still further embodiment.

While the inventive subject matter is susceptible of various modifications and alternative embodiments, certain illustrated embodiments thereof are shown in the drawings and will be described below in detail. It should be understood, however, that there is no intention to limit the disclosure to any specific form disclosed, but on the contrary, the inventive subject matter is to cover all modifications, alternative embodiments, and equivalents falling within the scope of any appended claims. The specific embodiments discussed herein are merely illustrative of specific ways to make and use the invention and do not delimit the scope of the disclosure.

Thus, it is intended that the present disclosure covers such modifications and variations as come within the scope of the appended claims and their equivalents. Other objects, features, and aspects of the present disclosure are disclosed in, or are obvious from, the following detailed description. It is to be understood by one of ordinary skill in the art that the present discussion is a description of exemplary embodiments only and is not intended as limiting the broader aspects of the present disclosure. Referring generally to FIGS. 1-7, various exemplary embodiments of a sewing machine 10, a system 100, and a method 300 may be described in detail. Where the various figures may describe embodiments sharing various common elements and features with other embodiments, similar elements and features are given the same reference numerals and redundant description thereof may be omitted below.

Referring to FIGS. 1-6E, when discussing the sewing machine 10, the present disclosure may refer to a device that forms one or more stitches in a workpiece 40 with a reciprocating needle 30 and a length of sewing material 50, or thread 50. The sewing machine 10, as disclosed herein, may include, but is not limited to, sewing machines configured for forming particular stitches (e.g., a lock stitch, a chain stitch, a buttonhole stitch), embroidery machines, quilting machines, overlock or serger machines, or the like. Moreover, when referring to a stitch or stitchwork as part of a sewing operation, the present disclosure may refer to a loop formed with at least a portion of the sewing material 50 (or the thread 50), wherein at least a portion of the sewing material 50 passes through a hole formed in the workpiece 40.

Figure 2:
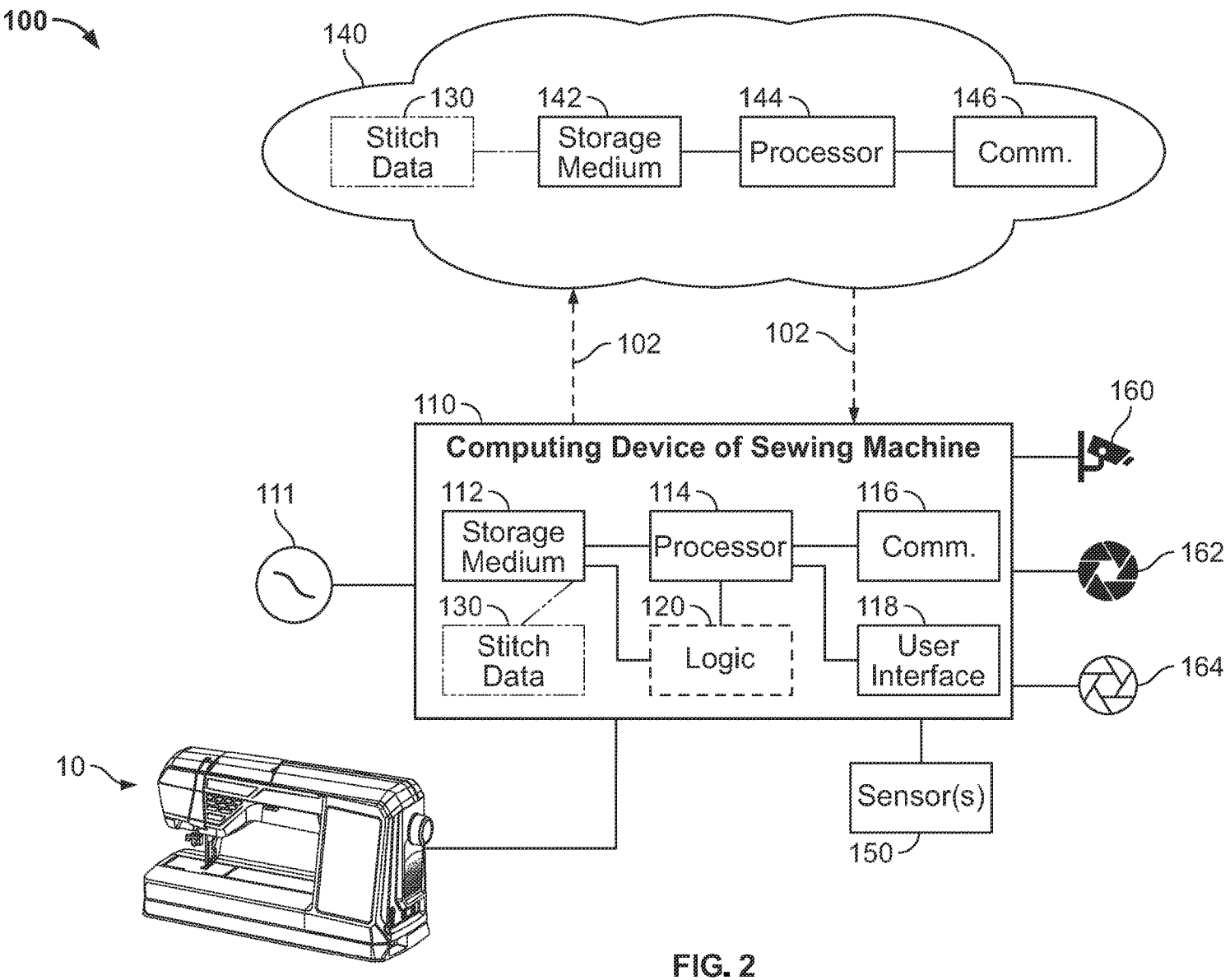
FIG. 2 is a block diagram representing an exemplary embodiment of a system having a computing device onboard a sewing machine, in accordance with the present disclosure.

Referring to FIG. 1, an exemplary embodiment of the sewing machine 10 is shown. The sewing machine 10 may be comprised of several structural components, including a base 20, a sewing bed 22 (or worktable 22), a pillar 24 (or tower 24), and an arm 26. The pillar 24 may extend upward from an end of the base 20, and the pillar 24 may support the arm 26, the arm 26 extending horizontally over the base 20 and the worktable 22. The worktable 22 is located atop the base 20, and the worktable 22 may constitute any portion of the sewing machine 10 on which the workpiece 40 (or a fabric 40) may be placed for a sewing operation. A user interface 118 may be provided on the pillar 24, the user interface 118 enabling input of instructions or control of a sewing operation via a computing device 110, as depicted in FIG. 2 and as discussed further below.

Figure 3:
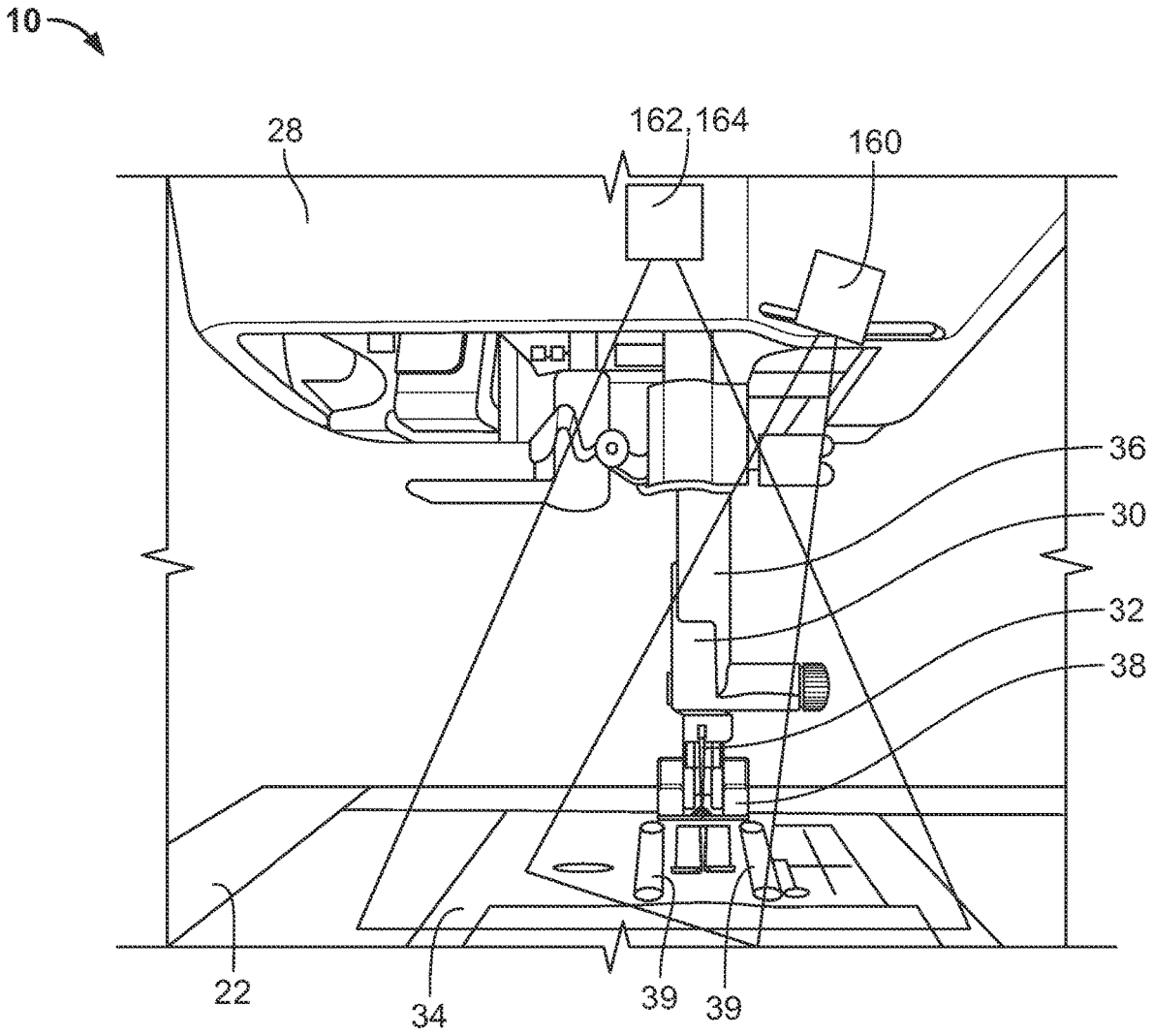
FIG. 3 is an enlarged, partial side-perspective view of a needle extending downward from a sewing head on an exemplary embodiment of a sewing machine, the sewing head housing a primary light source and a secondary light source, in accordance with the present disclosure.

Referring to FIGS. 1 and 3, a sewing head 28 is provided at a distal end of the arm 26. The sewing head 28 is spaced apart from the worktable 22 by a distance 29. A needle bar 30 holding the needle 32 extends downward from sewing head 28 to a needle plate 34 of the worktable 22. The needle plate 34 may have openings for the needle 32 to pass through when making or forming stitches in the workpiece 40. The sewing material 50 is provided to the needle 32 from spools (not shown) supported by the arm 26. In optional embodiments of the sewing machine 10, a bobbin (not shown) may be arranged beneath the needle plate 34. The bobbin (not shown) may assist in making or forming the stitches in the workpiece 40 by dispensing a lower thread (not shown) that is stitched together with the upper thread 50, the upper thread 50 being delivered through the workpiece 40 by the needle 32. In other optional embodiments of the sewing machine 10, such as an overlock machine or a serger machine, lower threads (not shown) are disposed by loopers (not shown). When thread 50 is led from a thread source, such as the spools (not shown), bobbin (not shown), or loopers (not shown), the sewing machine 10 is configured to change a direction of the thread 50. A tension of the thread 50 may be altered by various tensioning devices (not shown), which ensure that only a desired amount of thread 50 is dispensed and the thread 50 is requisitely tightened.

Extending downward from the sewing head 28 may also be a presser bar 36 having a presser foot 38 formed at a distal end thereof. The presser foot 38, by way of the presser bar 36, is arranged to press the workpiece 40 against the worktable 22, and, in optional embodiments of the sewing machine 10, against feed dogs 39 that move the workpiece 40 on the worktable 22 either from back to front or side to side. The feed dogs 39 may manipulate the workpiece 40 in coordination with the presser foot 38 at a speed of which may be fixed or variably controlled by a user of the sewing machine 10, as discussed further in connection with the system 100. In optional embodiments of the sewing machine 10, an accessory mount (not shown) may extend below the sewing head 28 for a holding a tool on or above the worktable 22.

In some embodiments of the sewing machine 10, including those embodiments of the sewing machine 10 that constitute an embroidery machine, a hoop (not shown), or a frame (not shown), may be attached to the worktable 22 and/or the base 20 by a holder (not shown), or a mount (not shown). The holder (not shown) may move the hoop (not shown) by actuation of the holder (not shown) from at least one actuator (not shown), the at least one actuator (not shown) configured to move the hoop (not shown) from left-to-right and back-to-front, thereby providing two-axis control of a position of the hoop (not shown).

The mechanical components of the sewing machine 10, such as the needle 32, the bobbin (not shown), spools (not shown), loopers (not shown), thread tensioning devices (not shown), and feed mechanisms (not shown), and the like (e.g., hooks) cooperate to form stitches in one or more pieces of the workpiece 40. By reciprocal (or cyclical) movement of each of the foregoing mechanical movements, one repetition of this movement may form one stitch, or a pattern of stitches, in the workpiece 40.

Referring FIG. 2, an exemplary embodiment of the system 100 is shown. The system 100 may include the computing device 110 that is onboard the sewing machine 10, and which may be configured to at least receive or transmit data to a server 140 by way of a communication module 116. The computing device 110 may store stitch data 130 and one or more sets of instructions, such as logic 120, in a volatile and/or non-volatile storage medium 112, or memory 112. The logic 120 may be configured to be executed by a processor 114 to perform at least one operation corresponding to the one or more sets of instructions, such as the operations described in the method 300. The computing device 110 may include the user interface 118, or the display unit 118. The user interface 118 may be configured to operate the sewing machine 10, at least in part, based upon one or more operations of the described herein, as executed by the processor 114. The computing device 110 may be powered by way of a power supply 111 (chargeable or non-chargeable), which may constitute a DC power source 111, and which may be operably connected to a 120V/220V residential or commercial outlet by way of an AC/DC power adapter (not shown).

The computing device 110 may be a standalone device or may be used in combination with at least one external component, such as at least one server 140, either locally or remotely communicatively couplable with the computing device 110—for example via a network 102. The communication module 116 of the computing device 110 may be configured to permit communication, via the network 102, with a communication module 146 of the at least one server 140, which may be performed by wired interface, wireless interface (e.g., Wi-Fi, Bluetooth, near-field communication, radio-frequency identification (RFID), or the like), or a combination thereof. The at least one server 140 may constitute one or more devices configured to store data, such as stitch data 130, in a volatile and/or non-volatile storage medium 142, or the memory 142. A processor 144 may be configured to operate upon one or more sets of instructions residing in the memory 142, and to perform at least one action described herein, including to initiate transmission, via the communication module 146, of stitch data 130 to the computing device 110. A network interface can be used to form the network 102, as between the computing device 110 and the at least one server 140 to facilitate distributed and/or remote computing, such as cloud-based computing—commonly referred to as "cloud computing."

It is understood that various operations, steps, or algorithms, including the method 300, as described in connection with the computing device 110 and the server 140, or alternative devices, can be embodied directly in hardware, in a computer program product such as a software module executed by the processor 114 or the processor 144, or in a combination of the foregoing. The computer program product can reside in a computer-readable medium, such as the memory 112 and/or the storage medium 142, comprising RAM memory, flash memory, ROM memory, EPROM memory, EEPROM memory, registers, hard disk, a removable disk, or any other form of computer-readable medium known in the art.

The processor 114 or the processor 144 may be a generic hardware processor, a special-purpose hardware processor, or a combination thereof. In embodiments having a generic hardware processor (e.g., a central processing unit (CPU) available from manufacturers such as Intel and AMD), the generic hardware processor is configured to be converted to a special-purpose processor by means of being programmed to execute and/or by executing a particular algorithm in the manner discussed herein for providing a specific operation or result, such as the logic 120. It should be appreciated that the processor 114 or the processor 144 may be any type of hardware and/or software processor and is not strictly limited to a microprocessor or any operation(s) only capable of execution by a microprocessor, in whole or in part. Examples of other processors may include microcontrollers, graphics processing units (GPUs), floating point units (FPUs), reduced instruction set computing (RISC) processors, digital signal processors (DSPs), field programmable gate arrays (FPGAs), etc. One or more cores of a single microprocessor and/or multiple microprocessor each having one or more cores can be used to perform the operations described as being executed by a processor herein, including the method 300. The processor 114 and/or the processor 144 can also be a processor dedicated to the training of artificial intelligence (AI) systems, including AI systems practicing machine learning and deep learning.

The logic 120 may refer to the hardware, firmware, or software, and combination thereof, having instructions that are to be performed by the processor 114 or the processor 144. The instructions may be embodied in various forms such as routines, algorithms, modules, or programs including separate applications or code from dynamically linked libraries (DLLs). By way of example, the logic 120 may require a software-controlled embodiment of the processor 114 or the processor 144, such as an application-specific integrated circuit (ASIC), programmed logic device, or other processor.

The user interface 118 may encompass a means of inputting information to be processed by the processor 114, and the user interface 118 may be associated with a display configured to graphically present, to a user of the sewing machine 10, conditions of a sewing operation for the sewing machine 10. In some embodiments, the means of inputting information may include a broad gamut of input devices, such as buttons, knobs, switches, keyboards, and the like. In embodiments where the user interface 118 features a touch-screen display, a user may interact with the touch-screen display through touch-sensitive overlay, which is configured to detect a location of a user's hand and/or fingers. In this embodiment, the user can interact with the user interface 118 by touching the screen in particular locations, and/or by performing various hand- or finger-based gestures against the touch-sensitive overlay, such as touch, touch and hold, pinch or spread, and touch and move (e.g., like a cursor).

The computing device 110 may be associated with other electro-mechanical components of the sewing machine 10. Such electro-mechanical components may include actuators (not shown) and motors (not shown), and other general mechanical components that may be controlled by the system 100, as to cause the movement of the various moving parts of the sewing machine, such as the needle 32, by way of the needle bar 30, the feed dogs 39, the bobbin (not shown), loopers (not shown), and the like. As an example, a speed of the actuators (not shown) and/or motors (not shown) can be controlled directly by input from a foot pedal (not shown) that is actuated by the user, or can otherwise be controlled via the computing device 110 that receives and interprets the foot pedal input before sending a signal to one or more controllers (not shown) that control the motors (no shown) of the sewing machine 10. Such actuators (not shown) and/or motors (not shown) may also be controlled through inputs made vis-à-vis the user interface 118.

As another example, the speed and frequency by which the needle bar 30 reciprocally moves up and down may be controlled by the user vis-à-vis the user interface 118. A type and pitch of a stitch can be selected by the user's input to the user interface 118, including conventional cyclical motion to form stitches longitudinally and side-to-side motion to form stitches in a zig-zag or tapered manner. As yet another example, the user interface 118 may provide a user with input control of a stitch rate—i.e., the period of time between successive, iterative stitches. The user may provide various inputs via-a-vis the user interface 118, such as increasing or decreasing the stitch rate, and/or entering a desired stitch rate. Input of these stitch rates may thereby automatically generate stitches based upon the period of time between the stitches—often referred to as "stitch time points." Other inputs to the user interface 118 may include other controls, such as selection of a color of the thread 50, a size setting of the hoop (not shown) in case of an embroidery being sewn, selection of a type of stitch, and other stitching-editing functions.

Various sensors 150, or data-gathering devices 150, may be associated with the computing device 110 of the sewing machine 10. The computing device 119 may be operably connected to the one or more sensors 150, each of which may be configured to measure various aspects related to the sewing machine 10 and a sewing operation thereof, including digital sensors, analog sensors, passive sensors, or active sensors, and the like, and to generate sense-based feedback to the computing device 110. For example, a tension sensor (not shown) may be arranged to measure a tension of the thread 50, so as to determine if the thread 50 is too loose or too tight, or to otherwise generate feedback indicating that a tension of the thread 50 is outside of an acceptable threshold for a sewing operation. Other sensors may include (but are not limited) to optical sensors, such as a camera 160 (as discussed further below), sensors configured to measure vibrational perturbations of the sewing machine 10, color-space sensors configured to measure RGB, CMYK, or greyscale color of the thread 50 or the workpiece 40, and other sensors, such as acoustic sensors, chemical sensors, fatigue-detection sensors, tilt or motion sensors (e.g., inertial measurement units), and magnetic-field sensors, and others known to a person having ordinary skill in the art of the sewing machine 10 and/or control systems thereof.

Referring to FIGS. 2-3, the computing device 110 may additionally be associated with the camera 160, which may be mounted within the arm 26 at, or proximate to, the sewing head 28 of the sewing machine 10. The camera 160 may be arranged such that its field of view is directed to the worktable 22, and onto the workpiece 40 where a workpiece 40 is set atop the worktable 22. The camera 160 may be configured to take one or more images, or capture a live-feed, of the worktable 22 (or the workpiece 40, where the workpiece 40 is set atop the worktable 22). The camera 160 may generate the one or more images or live feed, and such generated one or more images or live feed (e.g., in real time, or near-real time) may be transmitted to the computing device 110 as reference-image data, and thereby displayed on a display of the user interface 118. It is understood that a reference-image data may depend upon a resolution rate of the camera 160 or may otherwise be limited by the frame rate associated with the camera 160.

Figure 5A:
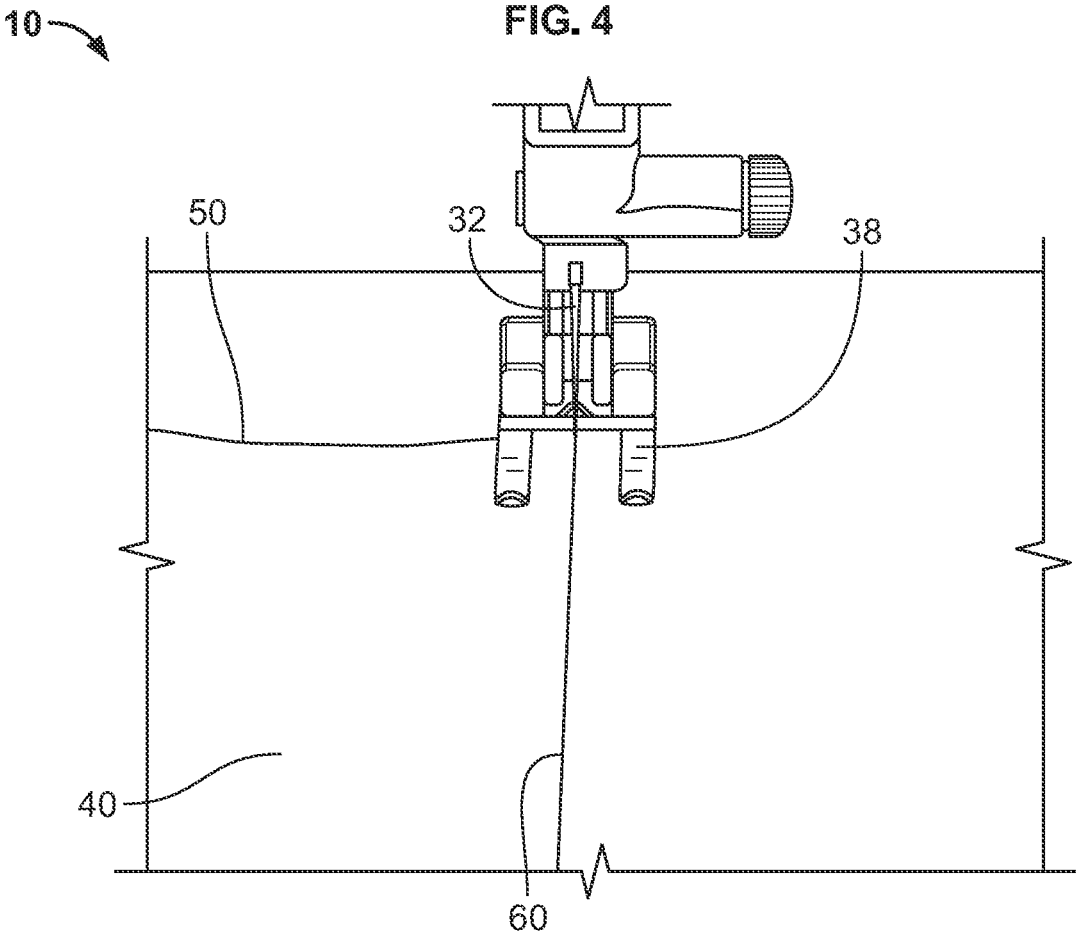
FIG. 5A is an enlarged, partial top-perspective view of a needle extending from a sewing head on an exemplary embodiment of a sewing machine, the sewing machine having a secondary light source projecting a reference line, in accordance with the present disclosure.
Figure 5B:
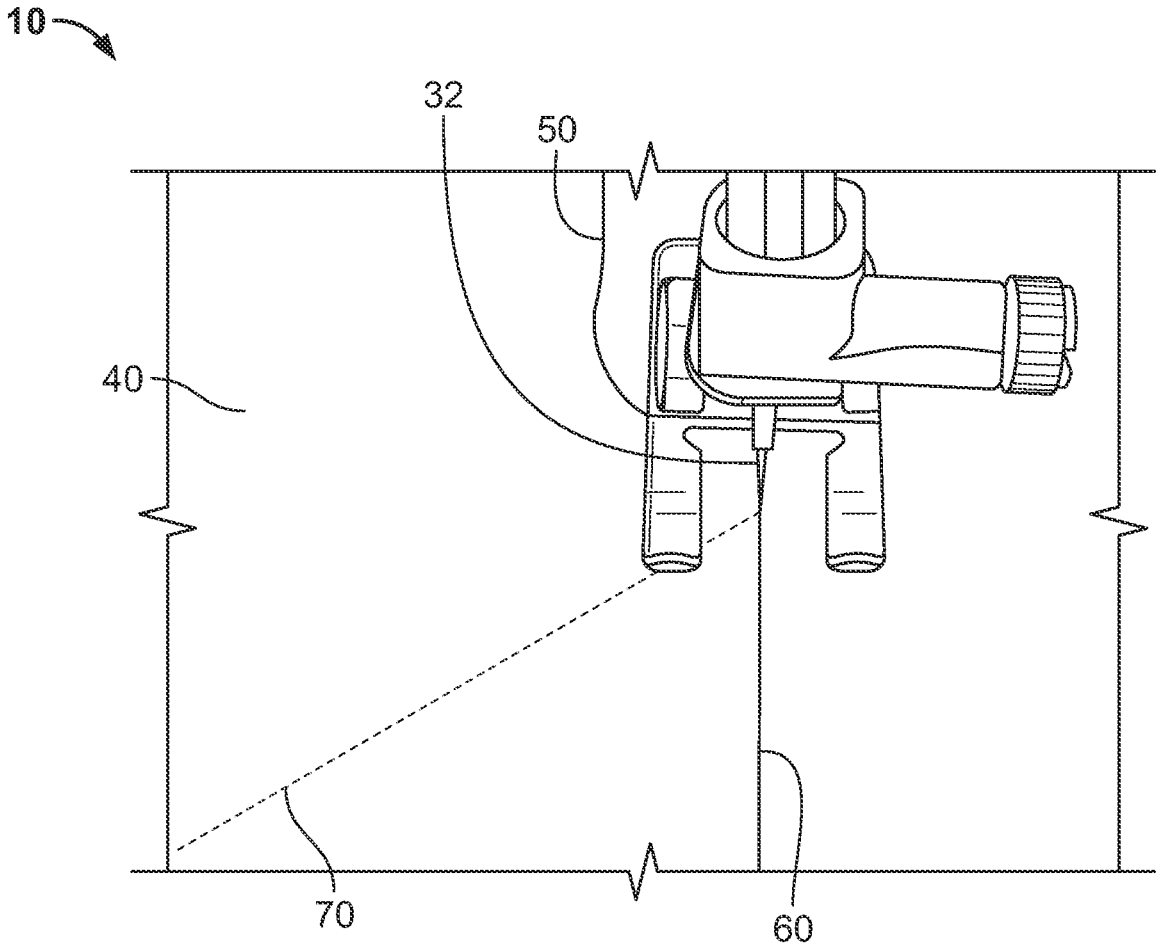
FIG. 5B is an enlarged, partial top-perspective view of a needle extending from a sewing head on an exemplary embodiment of a sewing machine, the sewing machine having a primary light source projecting a guideline, in accordance with the present disclosure.

The computing device 100 may further be associated a primary light source 162 (or primary projector 162) and a secondary light source 164 (or secondary projector 164), each of which may be mounted within the arm 26 at, or proximate to, the sewing head 28 of the sewing machine 10. Each of the primary light source 162 and the secondary light source 164 may be housed within the same light-emitting system, as shown in FIG. 3, or the primary light source 162 and the secondary light source 164 may be housed in separate light-emitting systems. Each of the primary light source 162 and the secondary light source 164 may comprise a light-emitting source, including lasers, such as gas-based lasers (e.g., $CO_2$-based) and semiconductor lasers, whether operating as continuous-wave lasers or pulsed lasers, light-emitting diodes (LEDs), lamps, such as metal halide and ultra-high performance (UHP) lamps, or other lumens known to those having ordinary skill in the art of the sewing machine 10 and an incorporation of projecting light sources therewith. The primary light source 162 may be configured to project one or more guidelines 70 onto the worktable 22 (or the workpiece 40, where the workpiece 40 is set atop the worktable 22), as depicted in FIG. 5B, and the secondary light source 164 may be configured to project a reference line 60 onto the worktable (or the workpiece 40, where the workpiece 40 is set atop the worktable 22), as depicted in FIGS. 5A-5B. In optional embodiments, the one or more guidelines 70 may appear as a straight line, similar to that of the reference line 60, or the one or more guidelines 70 may replicate a desired stitchwork of the sewing material 50.

Figure 7:
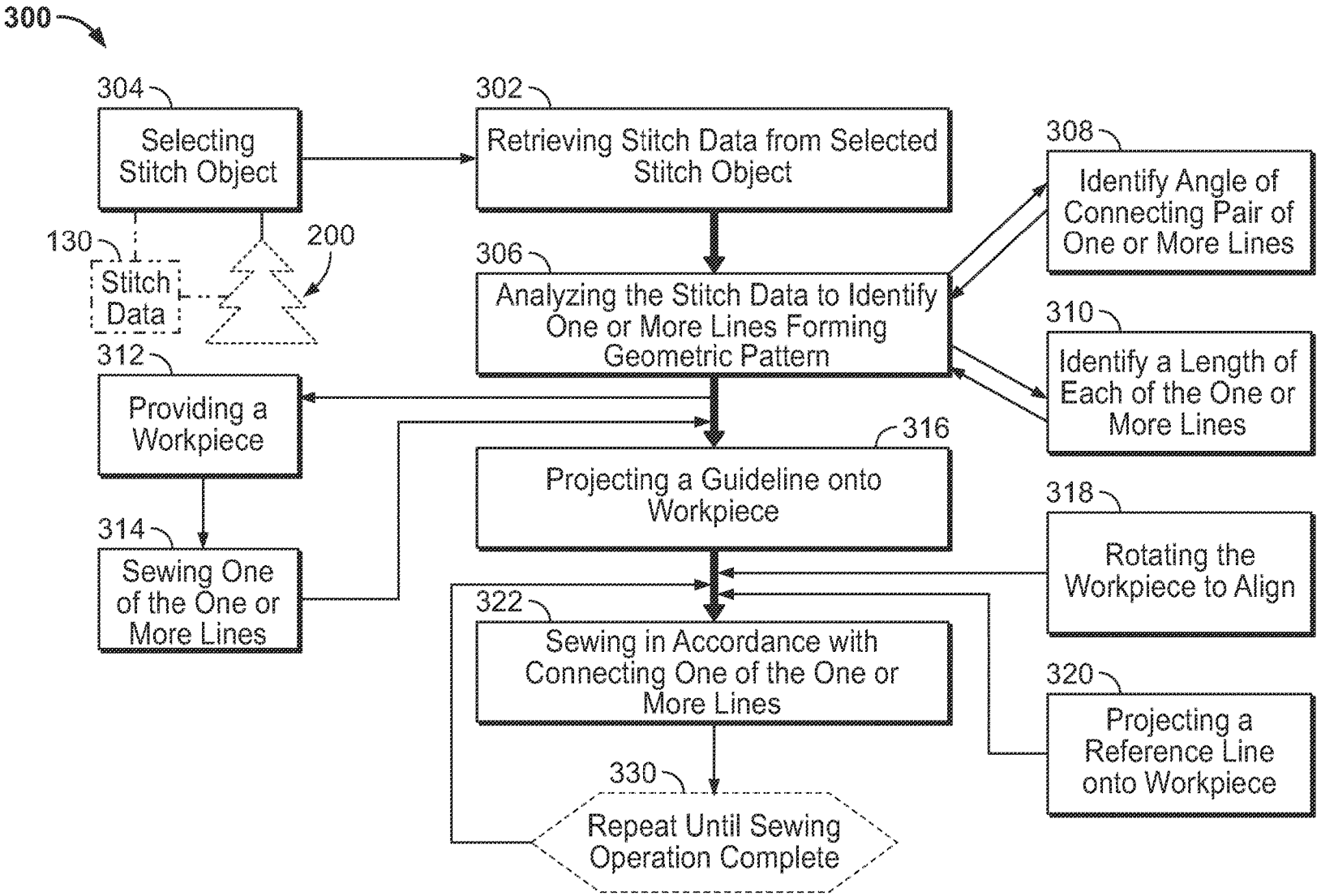
FIG. 7 is a flow chart representing an exemplary embodiment of a method for guiding a sewing operation of a sewing machine, in accordance with the present disclosure.

FIG. 7 illustrates a flowchart providing an exemplary embodiment of the method 300 of guiding a sewing operation of the sewing machine 10. As stated above, the logic 120 may be configured to be executed by a processor 114 to perform at least one operation corresponding to the one or more sets of instructions, such as the operations in the method 300, which are described in detail as follows. The method 300 of guiding the sewing operation may commence with an operation 302 of retrieving the stitch data 130 from the storage medium 112 of the computing device 110 or the storage medium 142 of the server 140 (by way of the network 102).

Figure 4:
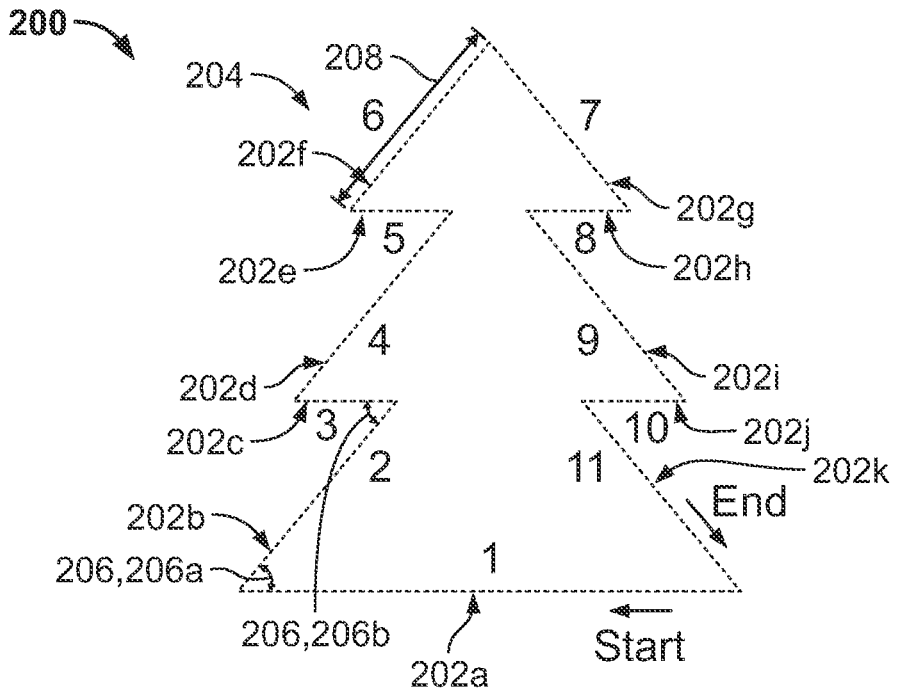
FIG. 4 is an exemplary embodiment of a stitch object defined by a geometric pattern, wherein one or more lines form the geometric pattern, in accordance with the present disclosure.

The stitch data 130 may be retrieved by an operation 304 of selecting one of one or more stitch objects 200, an exemplary embodiment of the one of the one or more stitch objects 200 depicted in FIG. 4. The one of the one or more stitch objects 200 may be selected by user input vis-à-vis the user interface 118, which may have displayed thereon a menu of or list of all of the one or more stitch objects 200 residing on the storage medium 112 (or accessed on the storage medium 142). By selecting the one or more stitch objects 200, the stitch data 130 may be selectively retrieved from the storage medium 112 of the computing device 110, or the storage medium 142 of the server 140. Referring to FIG. 4, each of the one or more stitch objects 200 may be defined by a geometric pattern 204, and any size, shape, or configuration associated therewith. The geometric pattern 204 may be formed by one or more lines 202, or contoured sides or edges 202. The one or more lines 202 forming the geometric pattern 204 may be defined as two-dimensional vectors in an x-y coordinate space. Each of these two-dimensional vectors may be correlated, by the logic 120 residing on the processor 114, with a two-dimensional plane defined by a surface of the worktable 22 (or the workpiece 40, where the workpiece 40 is set atop the worktable 22). By way of example, the x-axis of the x-y coordinate space may be defined along a longitudinal length of the arm 26, and the y-axis coordinate space may be defined as perpendicular to the x-axis, such that the y-axis is generally perpendicular to the longitudinal length of the arm 26. In optional embodiments, the stitch data 130 may comprise instructions other than the two-dimensional vectors in the x-y coordinate space, including data associated with stitch density, color of the thread 50, and various compensation factors.

As in FIG. 4, the exemplary embodiment one of the one or more stitch objects 200 may have a geometric pattern 204 in the shape or style of a tree, such as a holiday (Christmas) tree. The exemplary embodiment may be comprised of eleven of the one or more lines 204, beginning with a first line 202*a*, and ending with an eleventh line 202*k*. The geometric pattern 204 may be shaped as other geometries, such as polyhedral geometries, wherein the geometric pattern 204 may have, or otherwise contain (in part), a general shape of a triangle, a square, a rectangle, a rhombus, a parallelogram, a trapezoid, a pentagon, a hexagon, a heptagon, an octagon, a nonagon, or a decagon, and combinations thereof, as well as a shape having any more than ten of the one or more lines 204. The present disclosure is not intended to be so limiting as to what may comprise the geometric pattern 204, and it is understood by a person having ordinary skill in the art that the geometric pattern 204 may comprise a number of geometrical configurations having one or more lines 204 all capable of being sewn onto the workpiece 40 by the sewing machine 10.

Referring to FIG. 7, the method 300 may continue with an operation 306 of analyzing the stitch data 130 of the one of the one or more stitch objects 200. The operation 306 of analyzing the stitch data 130, as carried out by the processor 114, may be to identify the one or more lines 202 forming the geometric pattern 204, as discussed above. In optional embodiments, the operation 306 may further include an operation 308 of analyzing the stitch data 130 to identify an angle 206 of a connecting pair of the one or more lines 202, such angle 206 being generally limited by a number of the one or more lines 202 forming the geometric pattern 204. The angle 206 of the connecting pair of the one or more lines 202 may constitute either an internal angle 206*a* or an external angle 206*b*, it being understood that the angle 206 may range anywhere from zero degrees (0° to three-hundred sixty degrees (360°). In addition to the foregoing (or, in the alternative), the operation 306 may include an operation 310 of analyzing the stitch data 130 to identify a length 208 of each of the one or more lines 202 forming the geometric pattern 204. The length 208, which may comprise a measurement in an applicable degree of units (e.g., inches, centimeters, millimeters), may also comprise information pertaining to a "stitch length." The "stitch length" may comprise a distance that the workpiece 40 is moved as the repetition is performed by the sewing machine 10, and the "stitch length" measurement may be different for various types of repetitions or geometric patterns 204, and the "stitch length" can encompass one or more stitches in the workpiece 40.

The method 300 may continue by an operation 312 of providing the workpiece 40 to the sewing machine 10, by placing the workpiece 40 atop the worktable 22, as shown in FIGS. 5A-6E. The workpiece 40 may be positioned under the sewing head 28, such that the workpiece 40 is configured to have the needle 32 pass through the workpiece 40 with the sewing material 50 through reciprocal movement, as previously described. Upon placing the workpiece 40 under the sewing head 28 of the sewing machine 10, one or more of the sensors 150 may generate feedback to a user of the sewing machine 10 that the workpiece 40 is ready to have a sewing operation performed thereon. After providing the workpiece 40 to the sewing machine 10 in accordance with the operation 312, a user may initiate a "needle-down" function by a input to the user interface 118 or through manual control. In effect, the "needle-down" function is to lower the needle 32, by actuation of the needle bar 30, to a point of contact with the provided workpiece 40.

Figure 6A:
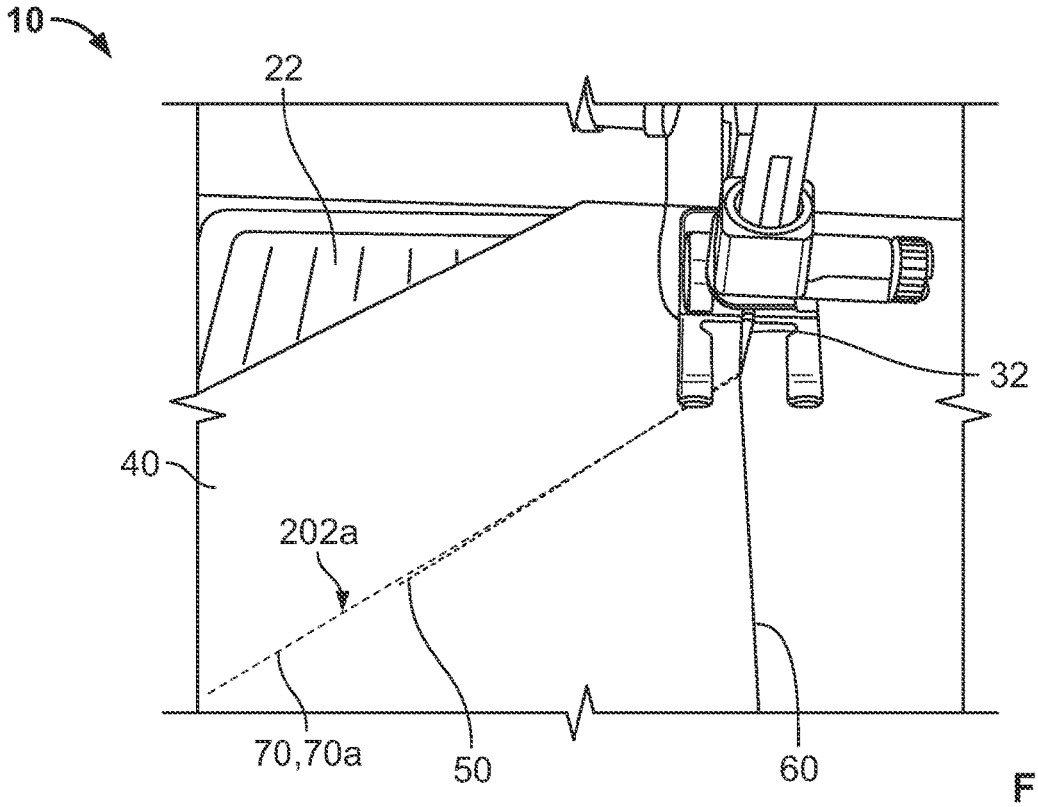
FIGS. 6A-6D are enlarged, partial top-perspective views of a needle extending from a sewing head on an exemplary embodiment of a sewing machine, the needle sewing at least a portion of sewing material in accordance with a guideline projected from a primary light source, in accordance with the present disclosure.

Referring to FIGS. 6A and 7, upon providing the workpiece 40 to the sewing machine 10 in accordance with the operation 312, the sewing machine 10 may sew at least a portion of the sewing material 50 onto the workpiece 40 with the needle 32, as in an operation 314. The at least a portion of the sewing material 50 may be sewn in a direction defined by a one, or a first, of the one or more lines 202 forming the geometric pattern 204, such as the line 202*a*, as depicted in FIG. 6A. The sewing operation may be performed by manual control of the sewing machine 10 or user input into the user interface 118, or alternatively, the sewing machine 10 may be configured to sew the at least a portion of the sewing material 50 through automated means, such that the needle 30 ceases actuation when the first of the one or more lines 202 is sewn. The computing device 110 may be configured to detect when the first of the one or more lines 202 is sewn, with each of the one or more lines 202 forming the geometric pattern 204 having the length 208 associated therewith, and such length 208 being ascertained by analyzing, via the processor 114 in association with the logic 120, the stitch data 130.

Figure 6B:
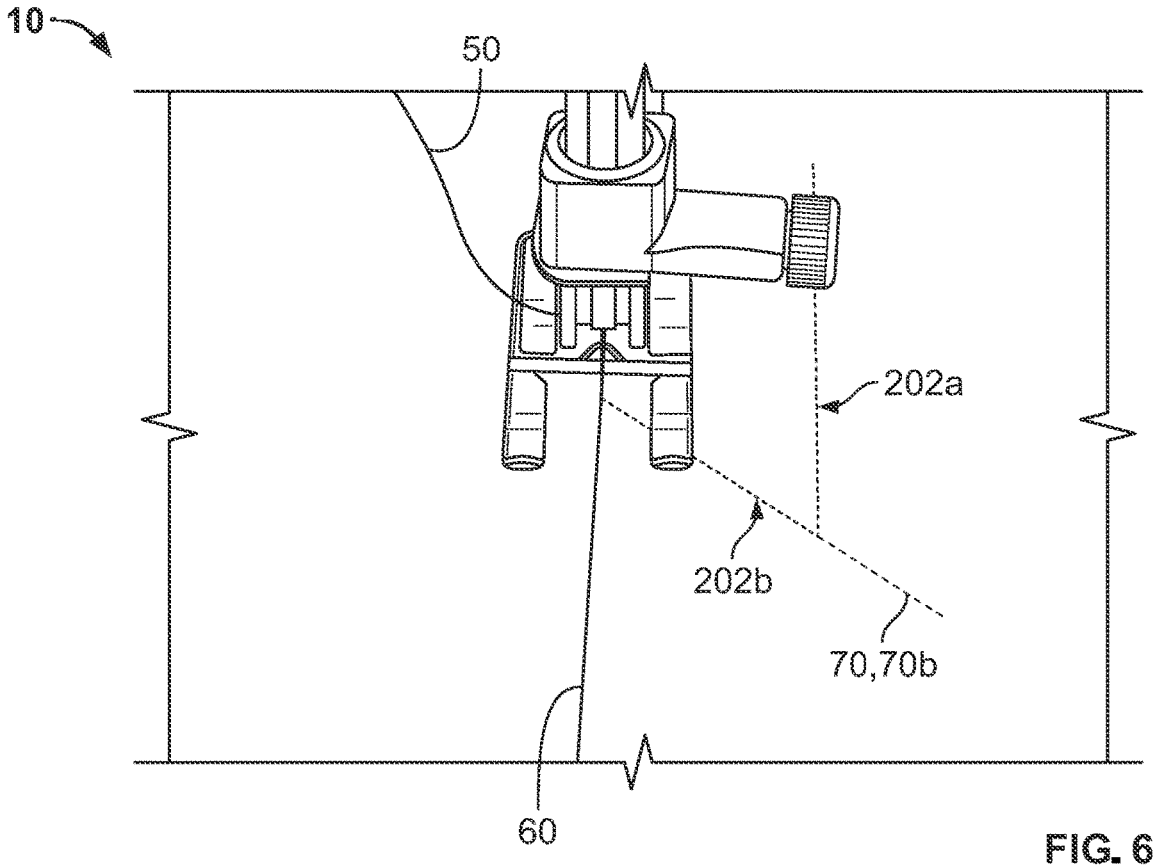

Upon sewing the sewing material 50 onto the workpiece 40, an operation 316 of activating the primary light source 162 may follow, where the primary light source 162 projects a guideline 70 onto the workpiece 40. The primary light source 162 may be directed to activate by the processor 114 of the sewing machine 10, such activation triggered by a user input into the user interface 118 or other means. As shown in FIG. 6A, the guideline 70 may be indicate a direction of a successive second or more of the one or more lines 202, such as lines 202*b*, 202*c*, . . . 202*k*, all of which form the geometric pattern 204 of the stitch object 200. A first of the one or more guidelines 70*a* may be aligned with the first of the one or more lines 202*a*. Upon alignment, a direction of a second one of the one or more lines 202*b* is indicated in a natural sewing direction of the sewing machine 10. The user may trigger a sewing action, either by pressing the foot pedal (not shown) or actuating a sewing operation via the user interface 118. After triggering the sewing action, the thread 50 will be sewn onto the workpiece 40 until the processor 114 issues a command to stop the sewing action, whether such command is configured to automatically stop the reciprocal movement of the needle 32 by sending a signal to a motor (not shown) or actuator (not shown) driving the movement, or whether such command is otherwise indicated to the user via a display on the user interface 118. Such command is initiated by the processor 114 when the processor 114 reads, from the stitch data 130, that a then-present line 202 has reached its end in sewing. Upon stopping the sewing action, the processor 114 may then indicate to the user, via a display of the user interface 118, the next sewing action that requires a user input to the user interface 118 and/or other action. Referring to FIGS. 6A-6B, a successive sequence (or transition) of sewing is shown, wherein the first line 202*a* and the second line 202*b* of one or more lines 202 has been sewn onto the workpiece 40. To align a successive guideline 70 with the second of the one or more lines 202*b*, an operation 318 of again rotating, or otherwise manipulating, the workpiece 40 may be required. The workpiece 40 may be rotated or otherwise manipulated, whether by, for example, a user's hand or by movement of the feed dogs 39. The sequence of these actions may be repeated until the whole geometric pattern 204 is sewn onto the workpiece 40, as discussed further below.

In embodiments of the method 300 where the stitch data 130 is analyzed to identify the angle 206 of a connecting pair of one or more lines 202, such as in the operation 308, the processor 114 of the sewing machine 10 may direct the primary light source 162 to project the first of the one or more guidelines 70*a* onto the workpiece 40. The first one of the one or more guidelines 70*a* may be projected onto the workpiece 40 in accordance with a direction defined by the first one of the one or more lines 202*a* forming the geometric pattern 204, such direction being determined by the angle 206 of the first of the one more lines 202*a* against the successive line (e.g., 202*b*) forming the geometric pattern 204. In embodiments of the method 300 where the stitch data 130 is analyzed to identify the length 208 of the one or more lines 202 forming the geometric pattern 204, such as in the operation 310, the processor 114 of the sewing machine 10 may direct the primary light source 162 to project the first one of the one or more guidelines 70*a* onto the workpiece 40. The first one of the one more guidelines 70*a* may be projected onto the workpiece 40, so as to provide a direction based on a relationship between a previous line, a first of the one or more lines 202*a*, and a successive line, a second of the one or more lines 202*b*. Such direction may be determined by the processor 114 reading, from the stitch data 130, a length 208 of the previous line, the first one or more lines 202*a*, as with respect to a length 208 of the successive line, the second of the one or more lines 202*b*.

As shown in FIGS. 5A-6D, the method 300 may contain an operation 320*m*, where the processor 114 activates the secondary light source 164 to project the reference line 60. The reference line 60 may indicate a direction in which the at least a portion of the sewing material 50 is be sewn onto the workpiece 40. The reference line 60, which serves as a common reference line, is configured to indicate a natural direction of sewing, the natural direction being the direction in which the sewing machine 10 feeds the sewing material 50. The secondary light source 164 may be arranged to provide other visual information onto the workpiece 40, so as to aid a user in performing a sewing operation with the sewing machine 10. For example, the secondary light source 164 can project a "needle drop point" onto the workpiece 40 so that the user can see the location of the needle 32 before a stitch is made onto the workpiece 40. Lines, such as the reference line 60, may be projected onto the workpiece 40 to assist the user in sewing in a straight line or along a desired path. In effect, the secondary light source 164 is capable of projecting lines, such as the reference line 60, or other images onto the workpiece 40, to enable the user to position stitchwork onto the workpiece 40 in a desired location and along a desired path or direction.

Referring to FIGS. 6B and 7, the method 300 may continue with an operation 322 of sewing, onto the workpiece 40 with the needle 32, at least a portion of the successive, connecting one or more lines forming the geometric pattern 204. In the context of the embodiment of the geometric pattern 204 of FIG. 6B, the sewing material 50 may be sewn in accordance with a direction defined by a second of the one or more lines 202*b* forming the geometric pattern 204. Just as with the operation 314, sewing may be performed by manual control of the sewing machine 10 or user input into the user interface 118, or alternatively, the sewing machine 10 may be configured to sew the at least a portion of the sewing material 50 through automated means, such that the needle 30 ceases actuation when the first of the one or more lines 202 is sewn. The computing device 110 may be configured to detect and/or calculate when the first of the one or more lines 202 is sewn, with each of the one or more lines 202 forming the geometric pattern 204 having the length 208 associated therewith, and such length 208 being ascertained by analyzing, via the processor 114 in association with the logic 120, the stitch data 130.

Figure 6C:
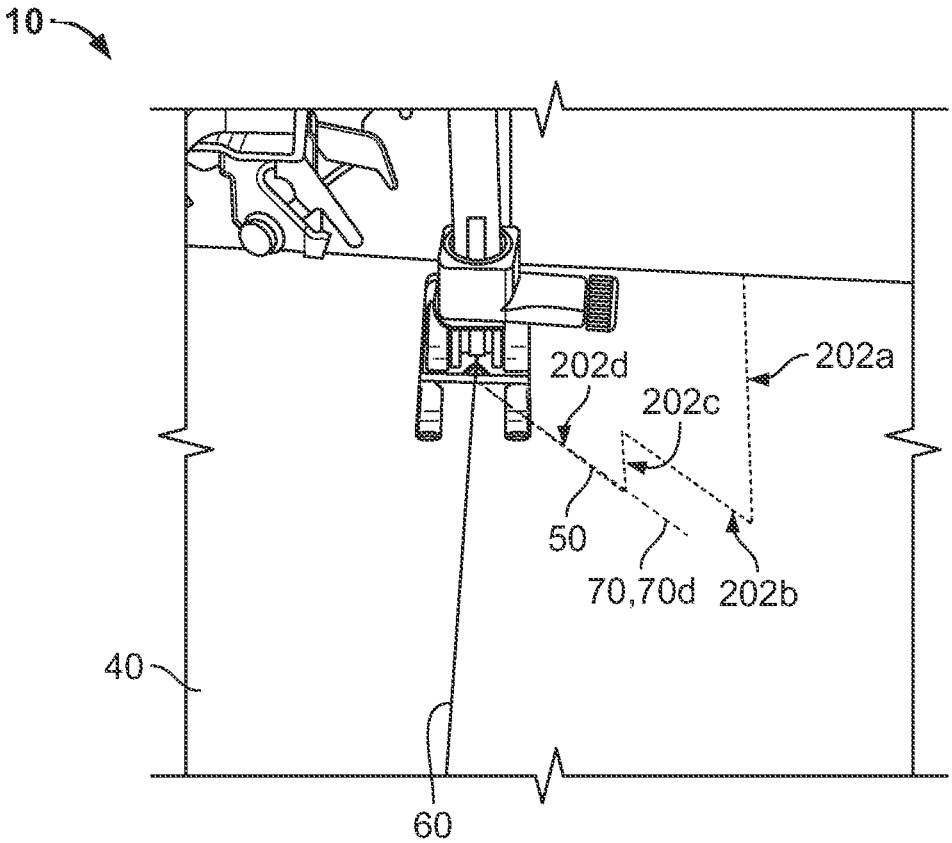
Figure 6D:
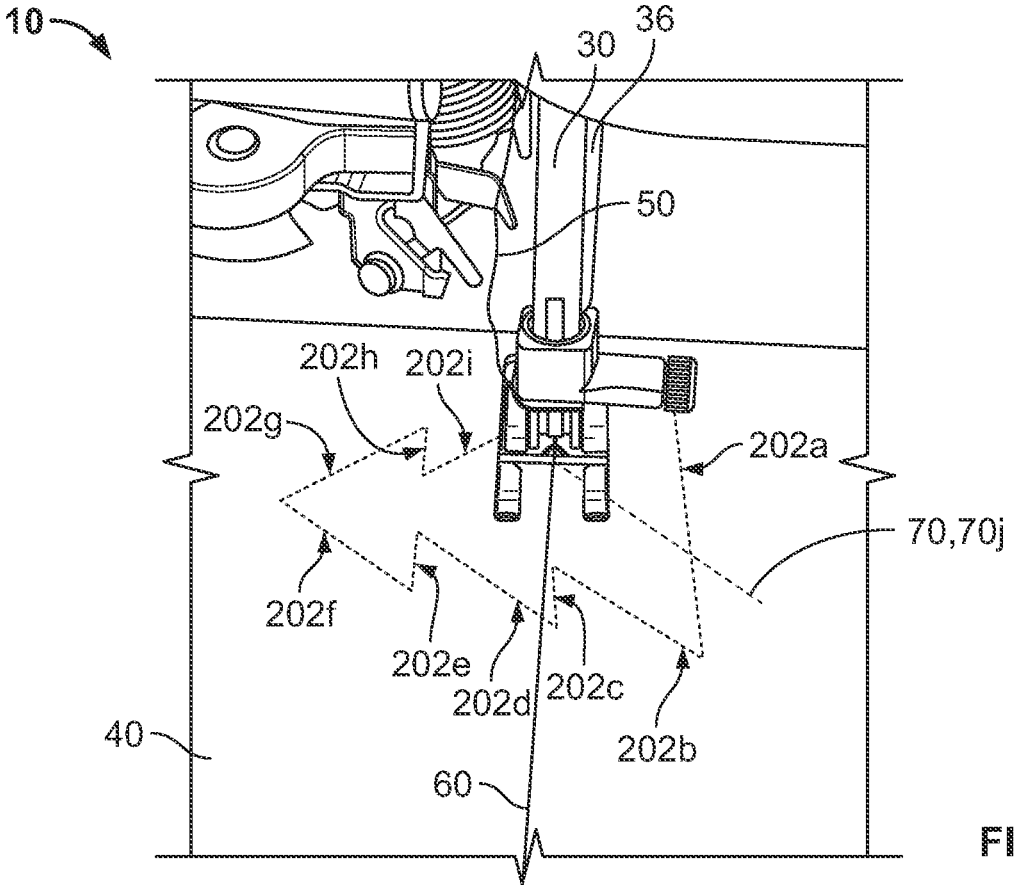
Figure 6E:
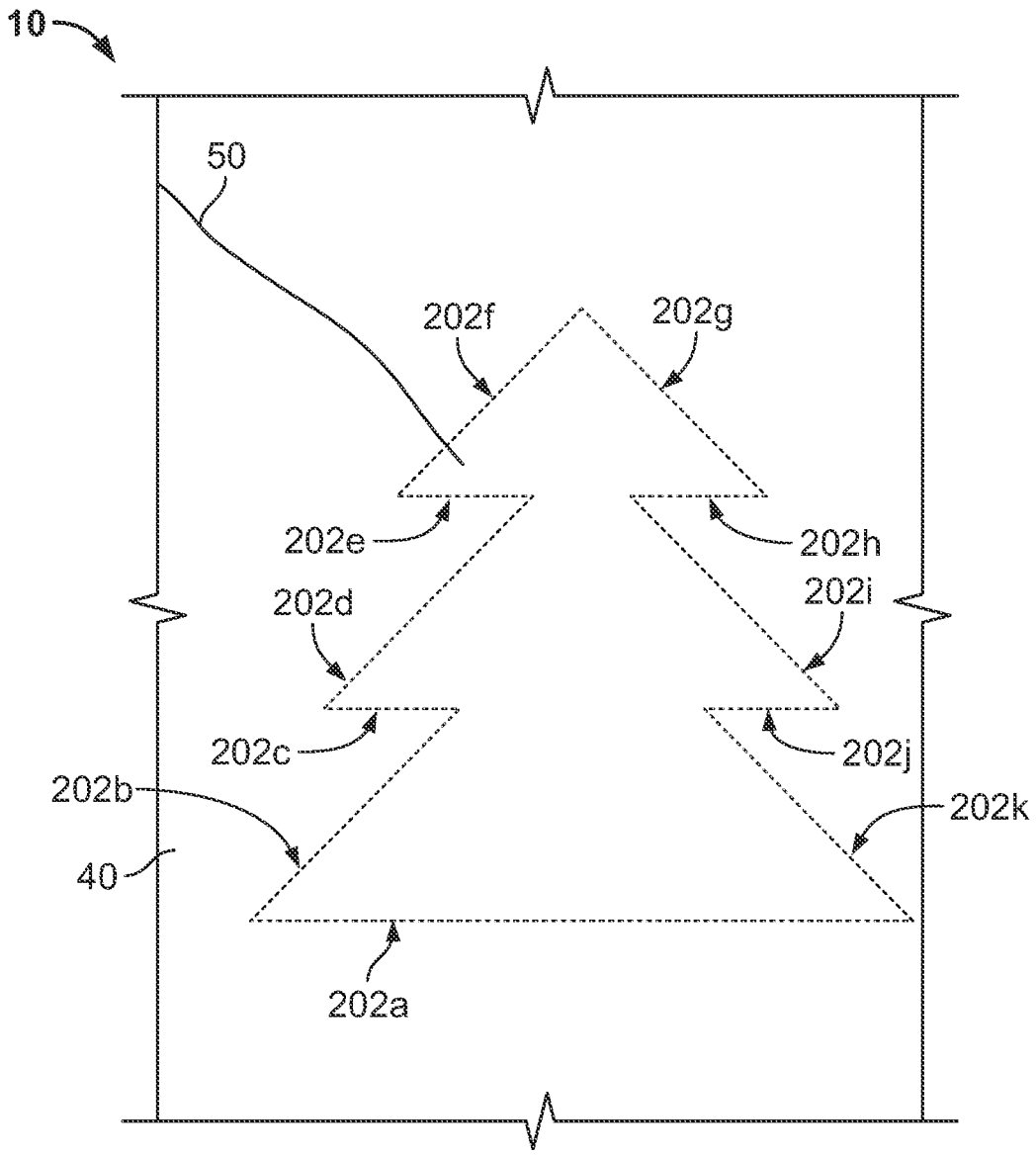
FIG. 6E is an enlarged, top plan view of a geometric pattern sewn onto a workpiece with sewing material, the geometric pattern sewn in accordance with the guideline projected from the primary light source, in accordance with the present disclosure.

Referring to FIGS. 6C-6D, the method 300 may repeat in accordance with an instruction defined by an operation 330, in which one or more guidelines 70 may be projected onto the workpiece 40, by the primary light source 162, to indicate a direction of a successive second or more of the one or more lines 202 forming the geometric pattern 204. As in FIG. 6C, the fourth of one or more guidelines 70*d* is projected along the fourth of the one or more lines 202*d* sewn into the workpiece 40, while in FIG. 6D, the tenth of the one or more lines 70*j* is to be projected along the tenth of the one or more lines 202*j* sewn into the workpiece 40. The processor 114 may be programmed to repeat, in succession, the operation 316 and the operation 322 until all of the one or more lines 202 are sewn onto the workpiece 40 to form a complete geometric pattern 204, as shown in FIG. 6E.

It should be apparent to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

To facilitate the understanding of the embodiments described herein, a number of terms have been defined above (and below). The terms defined herein have meanings as commonly understood by a person of ordinary skill in the areas relevant to the present disclosure. The terminology herein is used to describe specific embodiments of the disclosure, but their usage does not delimit the disclosure, except as set forth in the claims.

In the context of the mechanical components of the sewing machine 10, such as, e.g., the base 20, the sewing bed 22, the pillar 24, the arm 26, the sewing head 28, and various components associated with the needle 32 and needle plate 34, the terms "attached," "mounted," and "engaged," and the like, or any variation thereof, should generally be interpreted to mean any manner of joining two objects including, but not limited to, the use of any fasteners such as screws, nuts and bolts, bolts, pin and clevis, and the like allowing for a stationary, translatable, or pivotable relationship; welding of any kind such as traditional MIG welding, TIG welding, friction welding, brazing, soldering, ultrasonic welding, torch welding, inductive welding, and the like; using any resin, glue, epoxy, and the like; being integrally formed as a single part together; any mechanical fit such as a friction fit, interference fit, slidable fit, rotatable fit, pivotable fit, and the like; any combination thereof; and the like.

The term "user" as used herein unless otherwise stated may refer to an operator, or any other person or entity as may be, e.g., associated with the sewing machine 10 and the computing device 110 therein, for providing features and steps as disclosed herein.

Throughout the specification and claims, the following terms take at least the meanings explicitly associated herein, unless the context dictates otherwise. The meanings identified below do not necessarily limit the terms, but merely provide illustrative examples for the terms. The meaning of "a," "an," and "the" may include plural references, and the meaning of "in" may include "in" and "on." Further, ordinal indicators—such as "first," "second," "third," etc.—for identified elements are used to distinguish between the elements, and do not indicate or imply a required or limited number of such elements, and do not indicate a particular position or order of such elements unless otherwise specifically stated.

As used herein, the phrases "one or more," "at least one," and "one or more of," or variations thereof, when used with a list of items, means that different combinations of one or more of the items may be used and only one of each item in the list may be needed. For example, "one or more of" item A, item B, and item C may include, for example, item A or item A and item B. This example also may include item A, item B, and item C, or item B and item C.

The phrase "in one embodiment," "in optional embodiments," or "in another embodiment," and variations thereof, as used herein, do not necessarily refer to the same embodiment, although it may.

Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. The conditional language is not generally intended to imply that features, elements, and/or states are in any way required for one or more embodiments or that one or more embodiments necessarily include logic for deciding, with or without author input or prompting, whether these features, elements and/or states are included or are to be performed in any particular embodiment. Thus, such conditional language is not generally intended to imply that features, elements, and/or states are in any way required for one or more embodiments or that one or more embodiments necessarily include logic for deciding, with or without author input or prompting, whether these features, elements and/or states are included or are to be performed in any particular embodiment.

To the extent used herein, the term "about", or the like, is used to mean approximately, roughly, around, or in the region of. When the term "about" is used in conjunction with a numerical range, it modifies that range by extending the boundaries above and below the numerical values set forth. In general, the term "about" is used herein to modify a numerical value above and below the stated value by a variance of twenty-five percent (25%) up or down (higher or lower), unless stated otherwise in the disclosure. Unless the context dictates the contrary, all ranges set forth herein should be interpreted as being inclusive of their endpoints and open-ended ranges should be interpreted to include only commercially practical values. The recitation of numerical ranges of values herein is merely intended to serve as a shorthand method of referring individually to each separate value falling within the range. Unless otherwise indicated herein, each individual value of a numerical range is incorporated into the specification as if it were individually recited herein. Similarly, all lists of values should be considered as inclusive of intermediate values unless the context indicates the contrary.

The previous detailed description has been provided for the purposes of illustration and description. Thus, although there have been described particular embodiments of a new and useful SYSTEMS, METHODS, AND APPARATUSES FOR GUIDING A SEWING OPERATION OF A SEWING MACHINE, it is not intended that such references be construed as limitations upon the scope of this disclosure except as set forth in the following claims. Thus, it is seen that the apparatus, methods, and/or systems of the present disclosure readily achieve the ends and advantages mentioned as well as those inherent therein. While certain preferred embodiments of the disclosure have been illustrated and described for present purposes, numerous changes in the arrangement and construction of parts and steps may be made by those skilled in the art, which changes are encompassed within the scope and spirit of the present disclosure as defined by the appended claims.

What is claimed is:

1. A method for guiding a sewing operation of a sewing machine, the sewing machine having a needle configured to periodically pass through a workpiece by reciprocal movement, the method comprising:

selecting one of one or more stitch objects having stitch data associated therewith, each of the one or more stitch objects defined by a geometric pattern;

analyzing the stitch data of the one of the one or more stitch objects to identify one or more lines forming the geometric pattern;

sewing, onto the workpiece with the needle, at least a portion of a sewing material in a direction defined by a first of the one or more lines forming the geometric pattern;

detecting the at least a portion of the sewing material sewn onto the workpiece in the direction defined by the first of the one or more lines; and activating a primary light source to project a first of one or more guidelines onto the workpiece, the first of the one or more guidelines to be aligned with the first of the one or more lines to provide a direction of a second of the one or more lines forming the geometric pattern.

2. The method of claim 1, wherein:

activating the primary light source further comprises activating a secondary light source to project a reference line onto the workpiece, the reference line indicating a direction in which the at least a portion of the sewing material is configured to be sewn on the workpiece.

3. The method of claim 1, further comprising:

after activating the primary light source, sewing, onto the workpiece with the needle, the at least a portion of the sewing material in accordance with the second of the one or more lines forming the geometric pattern.

4. The method of claim 3, further comprising:

projecting, via the primary light source, a second of one or more guidelines onto the workpiece, the second of the one or more guidelines to be aligned with the second of the one or more lines to provide a direction of a third of the one or more lines forming the geometric pattern.

5. The method of claim 1, further comprising:

rotating the workpiece to sew, onto the workpiece with the needle, the at least a portion of the sewing material in a direction aligned with the second of the one or more lines forming the geometric pattern.

6. The method of claim 1, wherein:

the one or more lines forming the geometric pattern are defined as two-dimensional vectors in an x-y coordinate space.

7. The method of claim 1, wherein:

analyzing the stitch data of the one of the one or more stitch objects further includes to identify an angle of a connecting pair of the one or more lines forming the geometric pattern; and a direction of the first of one or more guidelines is determined by the angle connecting the first of the one or more guidelines with the at least a portion of the sewing material sewn on the workpiece in a direction defined by the first of the one or more lines forming the geometric pattern.

8. The method of claim 1, wherein:

analyzing the stitch data of the one of the one or more stitch objects further includes to identify a length of each of the one or more lines forming the geometric pattern; and a direction of the first of one or more guidelines is determined by the length of the at least portion of the sewing material sewn onto the workpiece in a direction defined by the first of the one or more lines forming the geometric pattern.

9. A method of operating a sewing machine having a processor configured to execute instructions residing on a memory, the memory having stitch data stored thereon, wherein the sewing machine has a needle configured to periodically pass through a workpiece by reciprocal movement, the method comprising:

selectively retrieving the stitch data in response to a selection of one of one or more stitch objects, each of the one or more stitch objects defined by a geometric pattern;

identifying one or more lines forming the geometric pattern of the one of the one or more stitch objects; and upon sewing, onto the workpiece with the needle, at least a portion of a sewing material in accordance with a direction defined by one of the one or more lines forming the geometric pattern, and detecting the at least a portion of the sewing material sewn onto the workpiece in the direction defined by the first of the one or more lines, projecting, from a primary light source, a guideline onto the workpiece, the guideline indicating a direction of a successive second or more of the one or more lines forming the geometric pattern, the second or more of the one or more lines connected to the one of the one or more lines on which the at least a portion of the sewing material was sewn.

10. The method of claim 9, further comprising:

activating a secondary light source to project a reference line onto the workpiece, the reference line indicating a direction in which the at least a portion of the sewing material is configured to be sewn on the workpiece.

11. The method of claim 9, further comprising:

rotating the workpiece to sew, onto the workpiece with the needle, the at least a portion of the sewing material in a direction aligned with the successive second or more of the one or more lines forming the geometric pattern.

12. The method of claim 9, wherein:

the one or more lines forming the geometric pattern are defined as two-dimensional vectors in an x-y coordinate space.

13. The method of claim 12, wherein:

the two-dimensional vectors in the x-y coordinate space are correlated with a two-dimensional plane defined by a surface of the workpiece.

14. The method of claim 9, wherein:

identifying the one or more lines further includes analyzing the stitch data to determine an angle of a connecting pair of the one or more lines forming the geometric pattern of the one of the one or more stitch objects; and a direction of the guideline is determined by the angle connecting the guideline with the at least a portion of the sewing material sewn on the workpiece in a direction defined by the one of the one or more lines forming the geometric pattern.

15. The method of claim 9, wherein:

identifying the one or more lines further includes analyzing the stitch data to determine a length of each of the one or more lines forming the geometric pattern of the one of the one or more stitch objects; and a direction of the guideline is determined by the length of the at least portion of the sewing material sewn onto the workpiece in a direction defined by the one of the one or more lines forming the geometric pattern.

16. A system for guiding a sewing operation of a sewing machine, the system comprising:

a sewing head arranged above a workpiece, the sewing head comprising a needle configured to periodically pass through a workpiece by reciprocal movement;

a primary light source configured to project one or more guidelines onto the workpiece;

a processor configured to execute instructions residing on a memory, the memory having stitch data stored thereon, the processor configured to:

receive a selection of one of one or more stitch objects, each of the one or more stitch objects defined by a geometric pattern;

analyze the stitch data of the one of the one or more stitch objects to identify one or more lines associated with the geometric pattern;

detect sewing material sewn onto the workpiece in a direction defined by one of the one or more lines associated with the geometric pattern; and direct the primary light source to project one of one or more guidelines onto the workpiece, the one of the one or more guidelines generated relative to a direction defined by the sewing material sewn onto the workpiece in accordance with the one of the one or more lines, the one of the one or more guidelines to be aligned with the one of the one or more lines to provide a direction of a successive, connecting one of the one or more lines associated with the geometric pattern.

17. The system of claim 16, further comprising:

a secondary light source configured to project a reference line onto the workpiece, the reference line indicating a direction in which the sewing material is configured to be sewn onto the workpiece.

18. The system of claim 16, wherein:

the one or more lines associated with the geometric pattern are defined as two-dimensional vectors in an x-y coordinate space.

19. The system of claim 16, wherein:

the processor is further configured to analyze the stitch data to identify an angle of a connecting pair of the one or more lines associated with the geometric pattern of the one of the one or more stitch objects.

20. The system of claim 16, wherein:

the processor is further configured to analyze the stitch data to determine a length of each of the one or more lines associated with the geometric pattern of the one of the one or more stitch objects.

* * * * *